US007931158B1

(12) United States Patent
Wu

(10) Patent No.: US 7,931,158 B1
(45) Date of Patent: Apr. 26, 2011

(54) TOOL SUSPENSION RACK THAT CAN BIND AND FASTEN A TOOL EASILY AND QUICKLY

(75) Inventor: Shih-Piao Wu, Changhua Hsien (TW)

(73) Assignee: Jiin Haur Industrial Co., Ltd., Lu Kang Town (TW)

( * ) Notice: Subject to any disclaimer, the term of this patent is extended or adjusted under 35 U.S.C. 154(b) by 613 days.

(21) Appl. No.: 12/025,014

(22) Filed: Feb. 2, 2008

(51) Int. Cl.
*A47F 7/00* (2006.01)

(52) U.S. Cl. ..... 211/70.6

(58) Field of Classification Search ..... 211/70.6; 206/372, 377, 376, 806, 349; 248/309.1; D8/373; 24/17 AP
See application file for complete search history.

(56) References Cited

U.S. PATENT DOCUMENTS

| | | | | | |
|---|---|---|---|---|---|
| 2,961,785 | A | * | 11/1960 | Toepfer | 40/669 |
| 3,072,986 | A | * | 1/1963 | Lefnaer | 24/16 PB |
| 3,780,400 | A | * | 12/1973 | Hinsperger | 24/16 PB |
| 4,466,159 | A | * | 8/1984 | Burrage | 24/16 PB |
| 4,631,783 | A | * | 12/1986 | Hayashi | 24/16 PB |
| 4,634,005 | A | * | 1/1987 | Kulzer et al. | 206/477 |
| 4,711,352 | A | * | 12/1987 | Williams et al. | 206/365 |
| 4,752,054 | A | * | 6/1988 | Jonsson | 248/51 |
| 5,044,591 | A | * | 9/1991 | Huang | 248/317 |
| 5,501,330 | A | * | 3/1996 | Betts | 206/349 |
| 5,581,850 | A | * | 12/1996 | Acker | 24/16 PB |
| D377,718 | S | * | 2/1997 | Abdi | D6/328 |
| 5,713,467 | A | * | 2/1998 | Kao | 206/349 |
| 5,836,053 | A | * | 11/1998 | Davignon et al. | 24/16 PB |
| 5,906,350 | A | * | 5/1999 | Kao | 248/688 |
| 5,967,340 | A | * | 10/1999 | Kao | 211/70.6 |
| 5,996,817 | A | * | 12/1999 | Kao | 211/70.6 |
| 6,164,463 | A | * | 12/2000 | Lee | 211/70.6 |
| 6,206,258 | B1 | * | 3/2001 | Calder | 224/420 |
| 6,227,399 | B1 | * | 5/2001 | Angus et al. | 220/375 |
| 6,235,987 | B1 | * | 5/2001 | Gamaggio-Schafer | 174/40 CC |
| 6,241,092 | B1 | * | 6/2001 | Vasudeva | 206/349 |
| 6,241,208 | B1 | * | 6/2001 | Lin | 248/309.1 |
| 6,283,311 | B1 | * | 9/2001 | Lee | 211/70.6 |
| 6,315,119 | B1 | * | 11/2001 | Lee | 206/349 |
| 6,425,482 | B1 | * | 7/2002 | Chiang | 206/349 |
| 6,640,393 | B2 | * | 11/2003 | Wendle | 24/16 PB |
| D486,381 | S | * | 2/2004 | Tsai | D8/373 |
| 6,719,154 | B2 | * | 4/2004 | Kao | 211/70.6 |
| 6,732,989 | B1 | * | 5/2004 | Kao | 248/309.1 |
| 6,808,069 | B1 | * | 10/2004 | O'Toole | 206/362.3 |
| 6,907,990 | B2 | * | 6/2005 | Hu | 206/378 |
| 6,935,516 | B2 | * | 8/2005 | Chiang | 211/70.6 |
| 6,961,979 | B2 | * | 11/2005 | Wendle | 24/16 PB |
| 7,131,535 | B2 | * | 11/2006 | Hernandez, Jr. et al. | 206/349 |
| 7,648,029 | B2 | * | 1/2010 | Chen | 206/376 |
| 2002/0070185 | A1 | * | 6/2002 | Chen | 211/70.6 |
| 2003/0034316 | A1 | * | 2/2003 | Kao | 211/70.6 |
| 2004/0099553 | A1 | * | 5/2004 | Chen | 206/349 |
| 2005/0061757 | A1 | * | 3/2005 | Chiang | 211/70.6 |
| 2005/0067307 | A1 | * | 3/2005 | Kao | 206/349 |
| 2005/0155945 | A1 | * | 7/2005 | Kao | 211/70.6 |
| 2006/0261018 | A1 | * | 11/2006 | Kao | 211/70.6 |
| 2007/0102382 | A1 | * | 5/2007 | Tuan Mu | 211/70.6 |

* cited by examiner

*Primary Examiner* — Sarah Purol
(74) *Attorney, Agent, or Firm* — Alan Kamrath; Kamrath & Associates PA

(57) ABSTRACT

A tool suspension rack includes a support board provided with two through holes, and an elongate flexible clamping strap extending through the two through holes of the support board and provided with a plurality of barb-shaped locking pieces extending through at least one of the two through holes of the support board and locked on a side of the support board. Thus, the locking pieces of the clamping strap in turn extend through the two through holes of the support board to clamp and tighten the tool between the clamping strap and the support board easily and quickly, thereby facilitating a user mounting the tool onto the tool suspension rack.

15 Claims, 9 Drawing Sheets

TOOL SUSPENSION RACK THAT CAN BIND AND FASTEN A TOOL EASILY AND QUICKLY

BACKGROUND OF THE INVENTION

1. Field of the Invention

The present invention relates to a tool suspension rack and, more particularly, to a suspension rack for hanging a tool, such as a gardening tool and the like, to provide a display function.

2. Description of the Related Art

A conventional tool suspension rack in accordance with the prior art shown in FIGS. 11 and 12 comprises a support board 60 and an elongate flexible clamping strap 50. The support board 60 is provided with two through holes 62. The clamping strap 50 has a first end provided with an insert 53 and a second end provided with a limit head 51. The clamping strap 50 has a side provided with a plurality of locking teeth 52. In assembly, the insert 53 of the clamping strap 50 initially extends through one of the two through holes 62 of the support board 60, then encompasses a tool 70, such as a gardening tool and the like, then extends through the other one of the two through holes 62 of the support board 60, and finally extends through and combine with the limit head 51 of the clamping strap 50 to clamp the tool 70 between the clamping strap 50 and the support board 60. At this time, the locking teeth 52 of the clamping strap 50 are locked on the limit head 51 of the clamping strap 50 so that the clamping strap 50 forms a loop so that the tool 70 is clamped and tightened between the clamping strap 50 and the support board 60.

However, the insert 53 of the clamping strap 50 initially extends through one of the two through holes 62 of the support board 60, then encompasses the tool 70, then extends through the other one of the two through holes 62 of the support board 60, and finally extends through and combine with the limit head 51 of the clamping strap 50 to clamp the tool 70 between the clamping strap 50 and the support board 60, so that the clamping strap 50 is not combined with the support board 60 easily and quickly, thereby greatly causing inconvenience to a user when mounting the tool 70 between the clamping strap 50 and the support board 60.

BRIEF SUMMARY OF THE INVENTION

In accordance with the present invention, there is provided a tool suspension rack, comprising a support board provided with two through holes, and an elongate flexible clamping strap extending through the two through holes of the support board and provided with a plurality of barb-shaped locking pieces extending through at least one of the two through holes of the support board and locked on a side of the support board.

The primary objective of the present invention is to provide a tool suspension rack that can bind and fasten a tool easily and quickly.

Another objective of the present invention is to provide a tool suspension rack, wherein the locking pieces of the clamping strap in turn extend through the two through holes of the support board to clamp and tighten the tool between the clamping strap and the support board easily and quickly, thereby facilitating a user mounting the tool onto the tool suspension rack.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
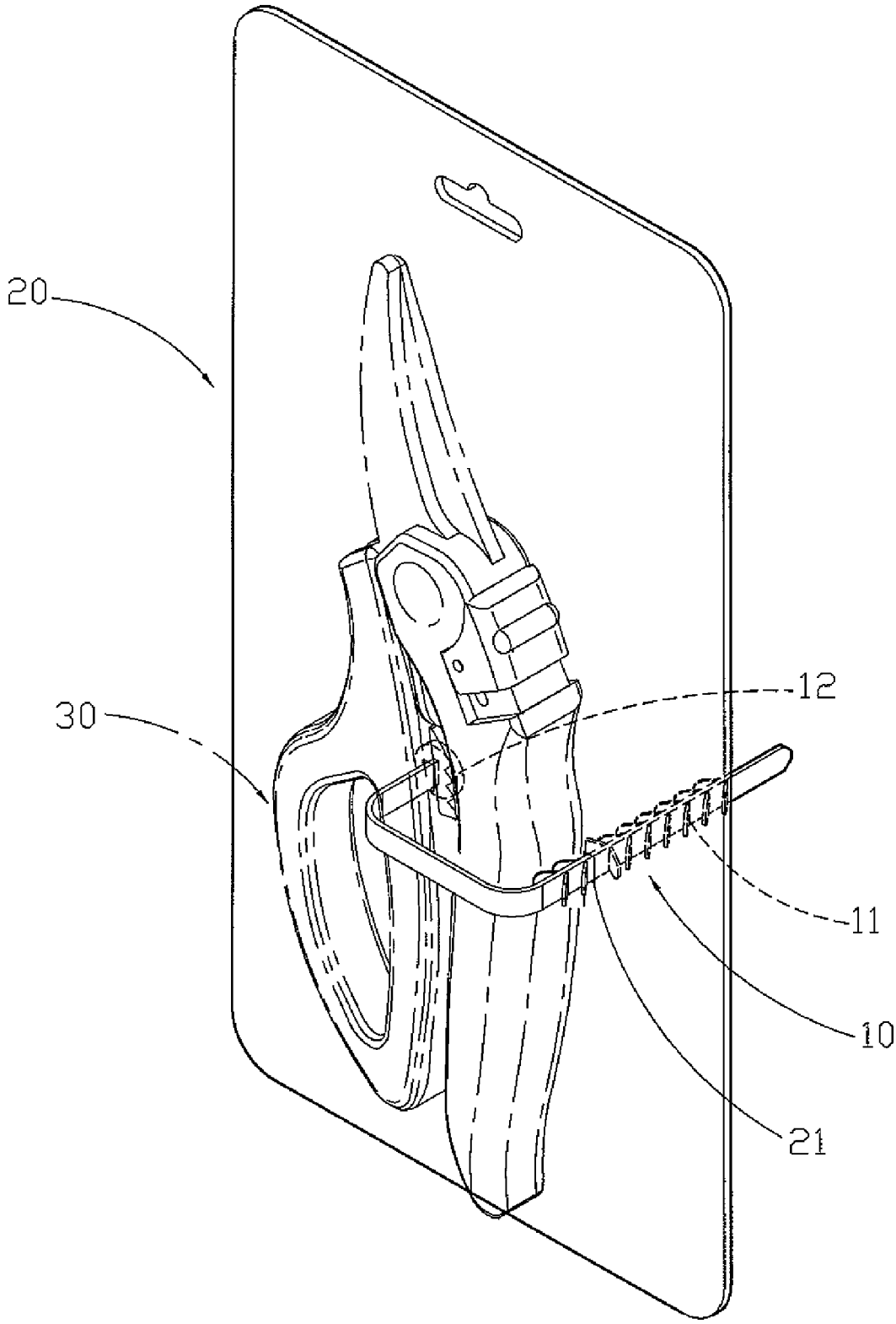
FIG. 1 is a perspective view of a tool suspension rack in accordance with the preferred embodiment of the present invention.

Referring to the drawings and initially to FIGS. 1-5, a tool suspension rack in accordance with the preferred embodiment of the present invention comprises a support board 20 provided with two through holes 21, and an elongate flexible clamping strap 10 extending through the two through holes 21 of the support board 20 and provided with a plurality of barb-shaped locking pieces 11 extending through at least one of the two through holes 21 of the support board 20 and locked on a side 22 of the support board 20.

In the preferred embodiment of the present invention, the clamping strap 10 has a first end provided with the locking pieces 11 and a second end provided with a limit head 12 abutting the side 22 of the support board 20. The limit head 12 of the clamping strap 10 has a substantially circular shape and has a size grater than that of each of the two through holes 21 of the support board 20. The locking pieces 11 of the clamping strap 10 are integrally formed on the clamping strap 10 and are arranged in pairs. The locking pieces 11 of the clamping strap 10 extend through each of the two through holes 21 of the support board 20. The locking pieces 11 of the clamping strap 10 project outwardly from two opposite sides of the clamping strap 10 in an oblique manner so that any two opposite locking pieces 11 of the clamping strap 10 have an acute angle to facilitate insertion of the locking pieces 11 of the clamping strap 10 through each of the two through holes 21 of the support board 20. One pair of the locking pieces 11 of the clamping strap 10 are expanded to have an obtuse angle and to abut the side 22 of the support board 20.

Figure 2:
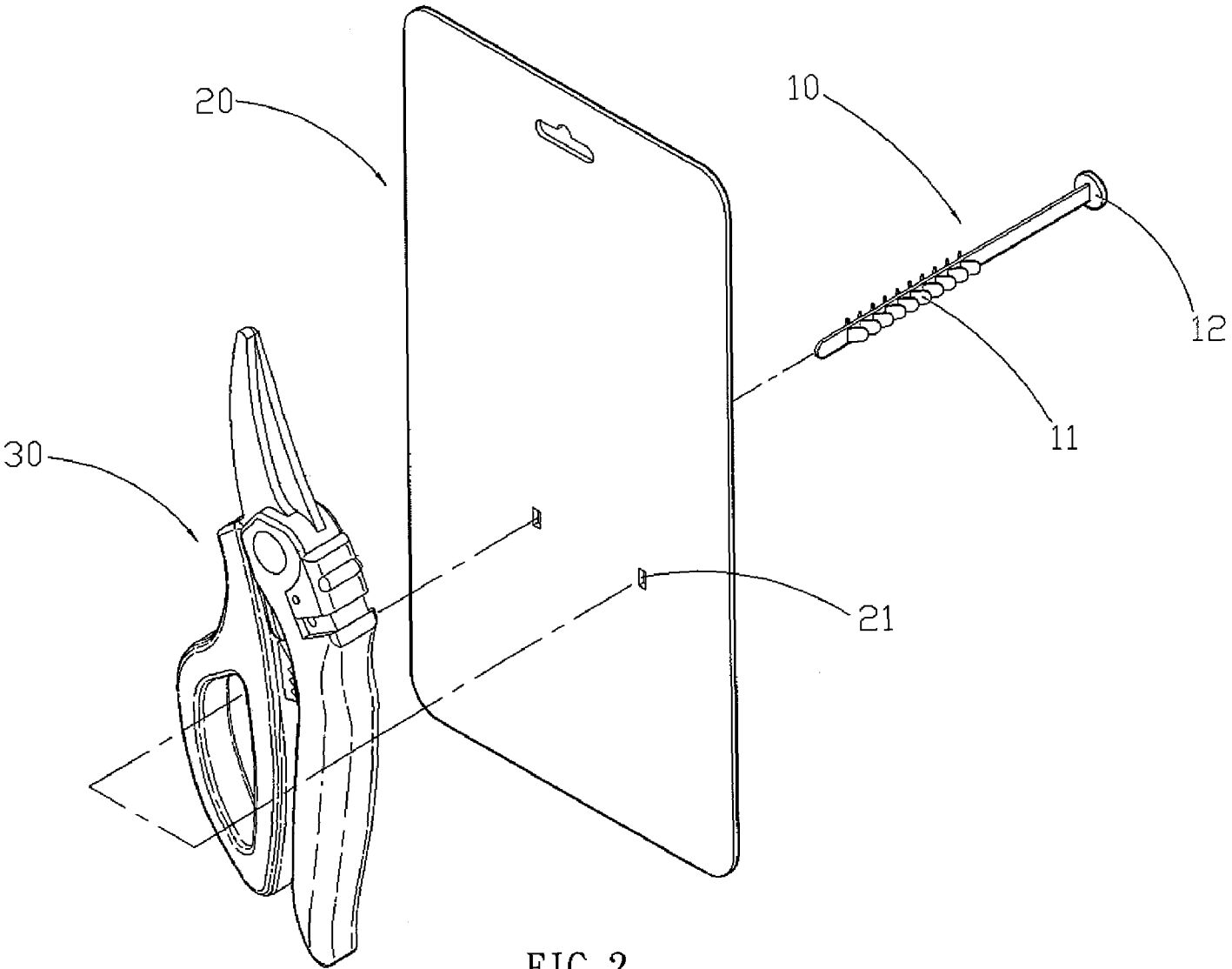
FIG. 2 is an exploded perspective view of the tool suspension rack as shown in FIG. 1.
Figure 3:
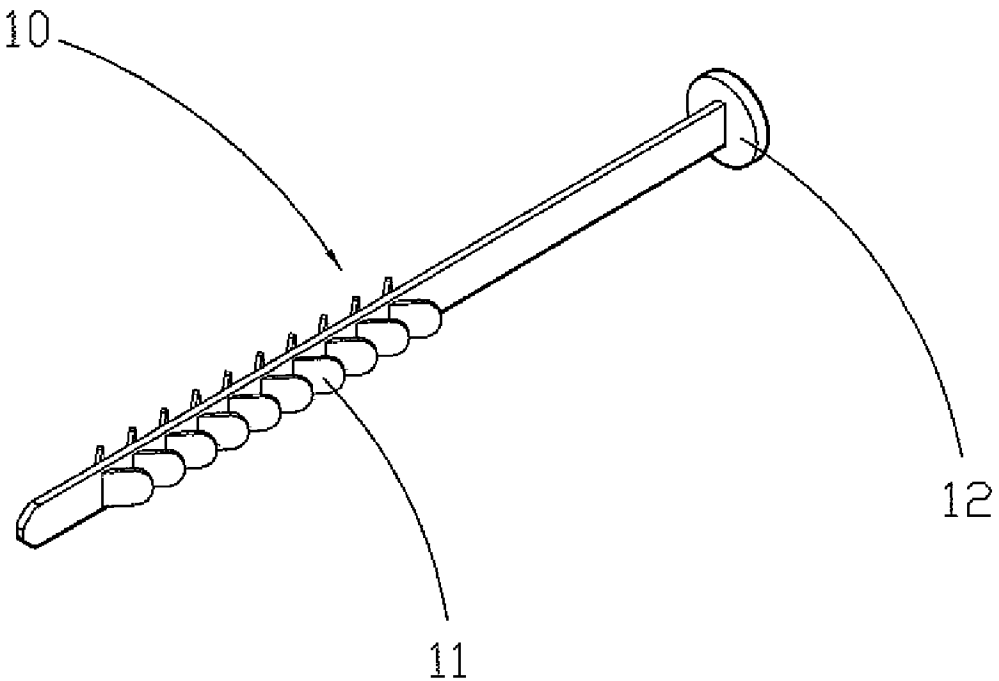
FIG. 3 is a perspective view of a clamping strap of the tool suspension rack as shown in FIG. 2.

In assembly, the locking pieces 11 of the clamping strap 10 extend through one of the two through holes 21 of the support board 20 as shown in FIG. 2 until the limit head 12 of the clamping strap 10 abuts the side 22 of the support board 20.

Figure 4:
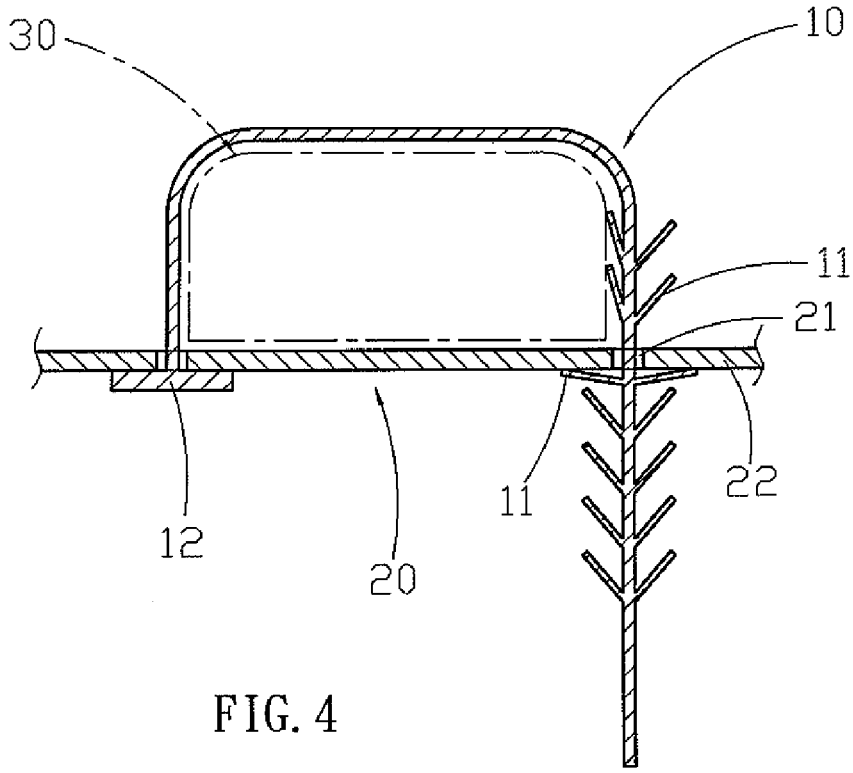
FIG. 4 is a top cross-sectional view of the tool suspension rack as shown in FIG. 1.
Figure 5:
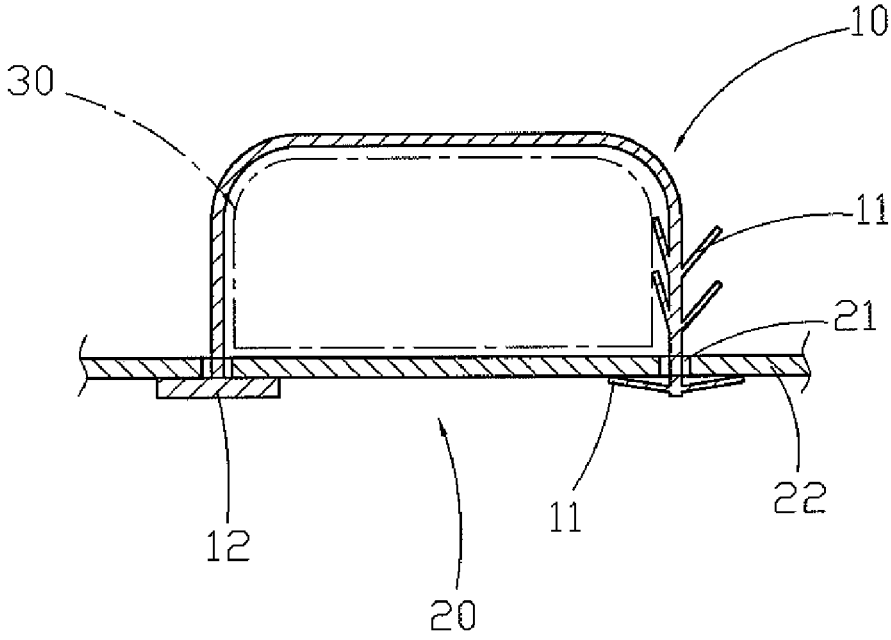
FIG. 5 is a top cross-sectional view showing the tool suspension rack as shown in FIG. 4 being cut partially.

Then, the clamping strap 10 is enclosed around a tool 30, such as a gardening tool and the like, to bind the tool 30. Then, the locking pieces 11 of the clamping strap 10 extend through the other one of the two through holes 21 of the support board 20 so as to clamp and tighten the tool 30 as shown in FIG. 4. At this time, one pair of the locking pieces 11 of the clamping strap 10 are expanded to have an obtuse angle and to abut the side 22 of the support board 20 so that the tool 30 is clamped between the clamping strap 10 and the support board 20 by limit of the limit head 12 and the locking pieces 11 of the clamping strap 10. Then, the residual locking pieces 11 of the clamping strap 10 projecting from the side 22 of the support board 20 are cut as shown in FIG. 5. Thus, the tool 30 is bound and clamped between the clamping strap 10 and the support board 20 so as to provide an exhibition function for purchase of a consumer.

Figure 6:
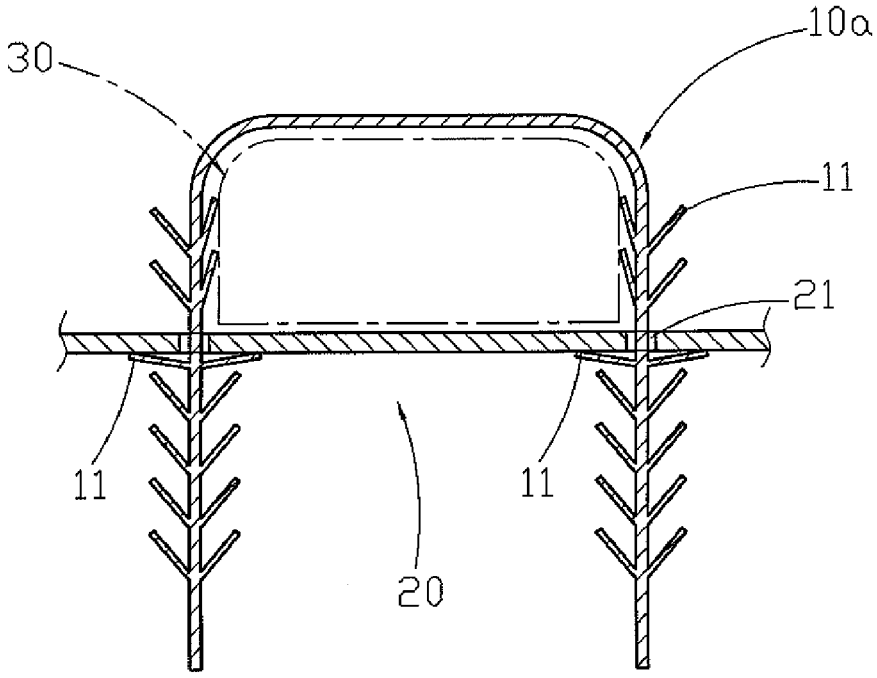
FIG. 6 is a top cross-sectional view of a tool suspension rack in accordance with another preferred embodiment of the present invention.
Figure 8:
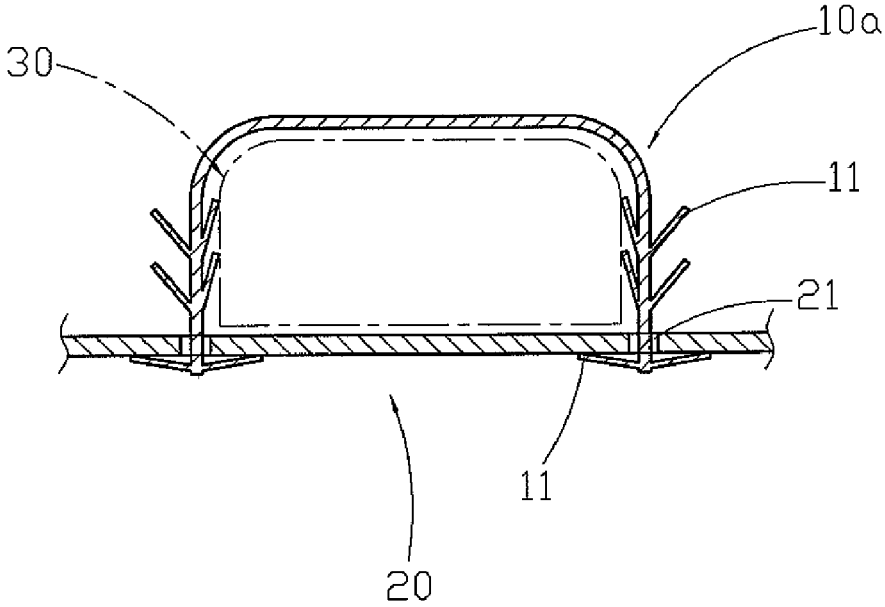
FIG. 8 is a top cross-sectional view showing the tool suspension rack as shown in FIG. 6 being cut partially.
Figure 7:
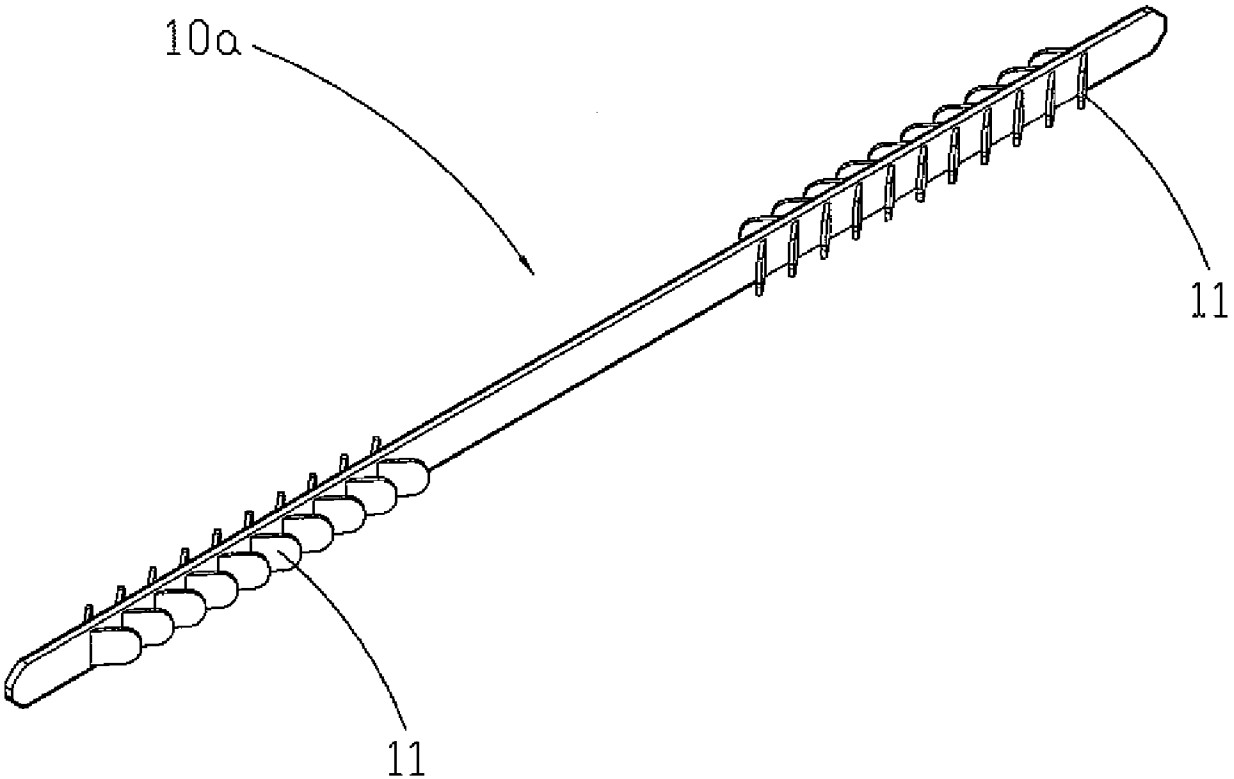
FIG. 7 is a perspective view of a clamping strap of the tool suspension rack as shown in FIG. 6.

Referring to FIGS. 6-8, the clamping strap 10*a* has two opposite ends each provided with the locking pieces 11. Thus, the locking pieces 11 of each of the two opposite ends of the clamping strap 10*a* extend through a respective one of the two through holes 21 of the support board 20 respectively as shown in FIG. 6.

Figure 9:
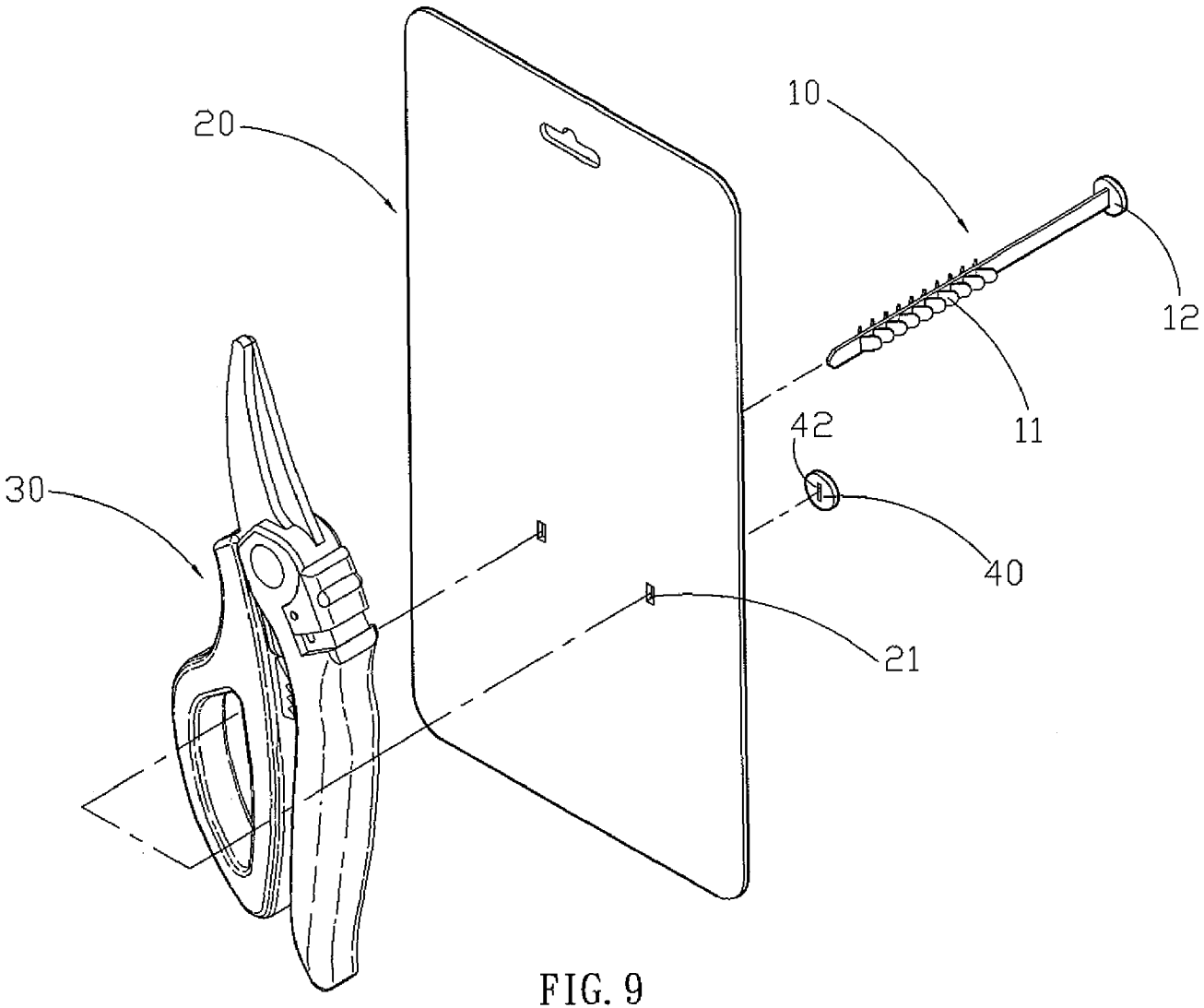
FIG. 9 is an exploded perspective view of a tool suspension rack in accordance with another preferred embodiment of the present invention.
Figure 10:
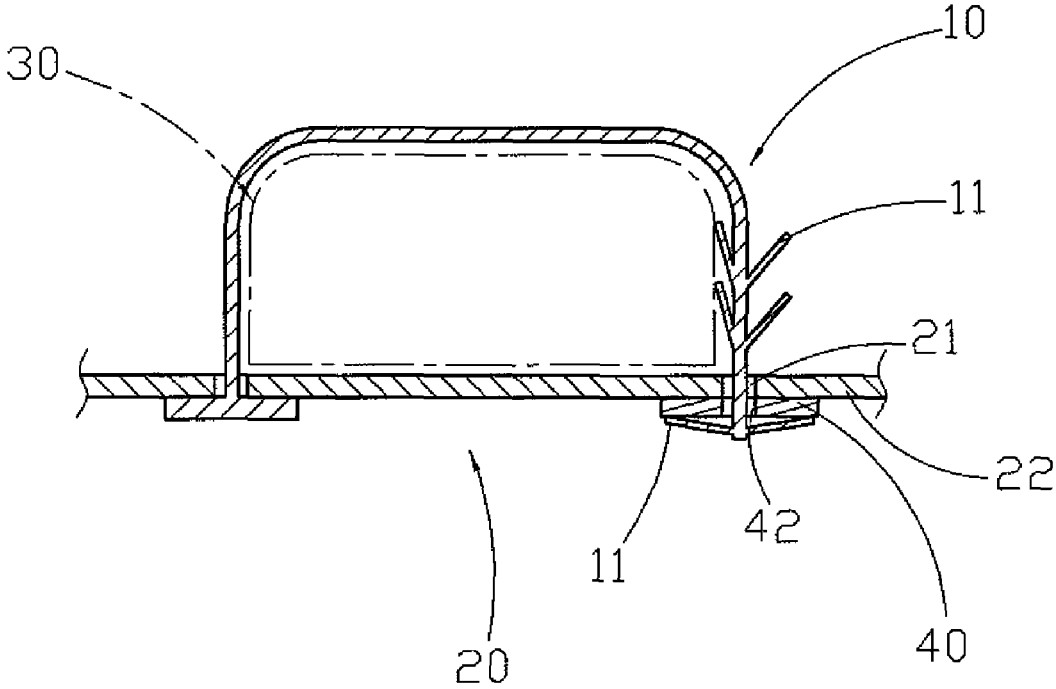
FIG. 10 is a top cross-sectional assembly view of the tool suspension rack as shown in FIG. 9.
Figure 12:
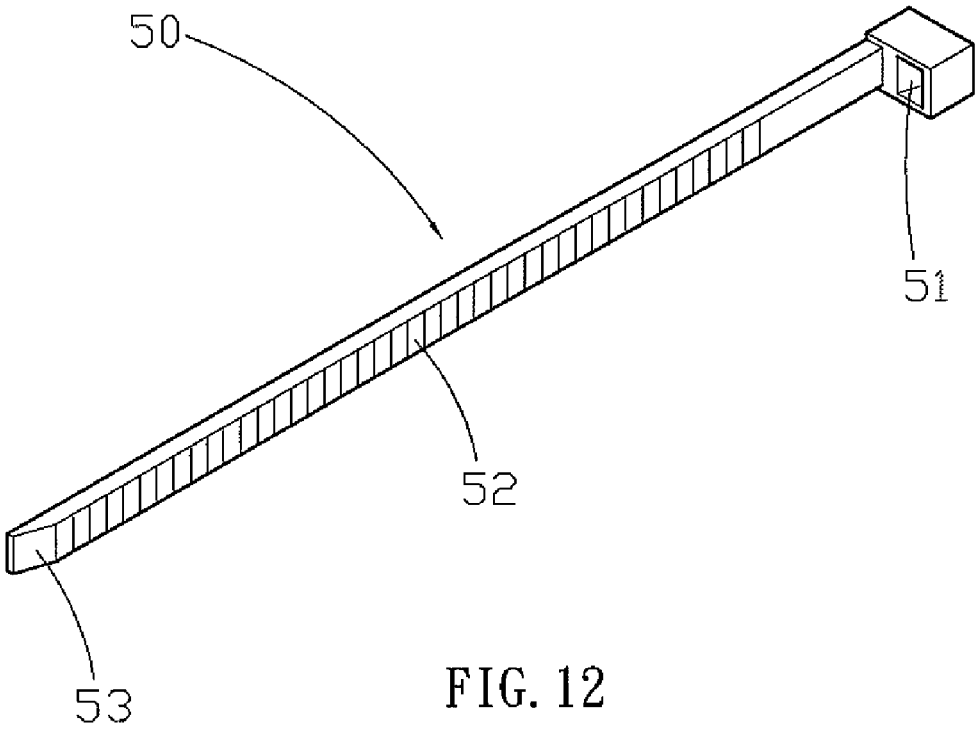
FIG. 12 PRIOR ART
FIG. 12 is a perspective view of a clamping strap of the conventional tool suspension rack as shown in FIG. 11.
Figure 11:
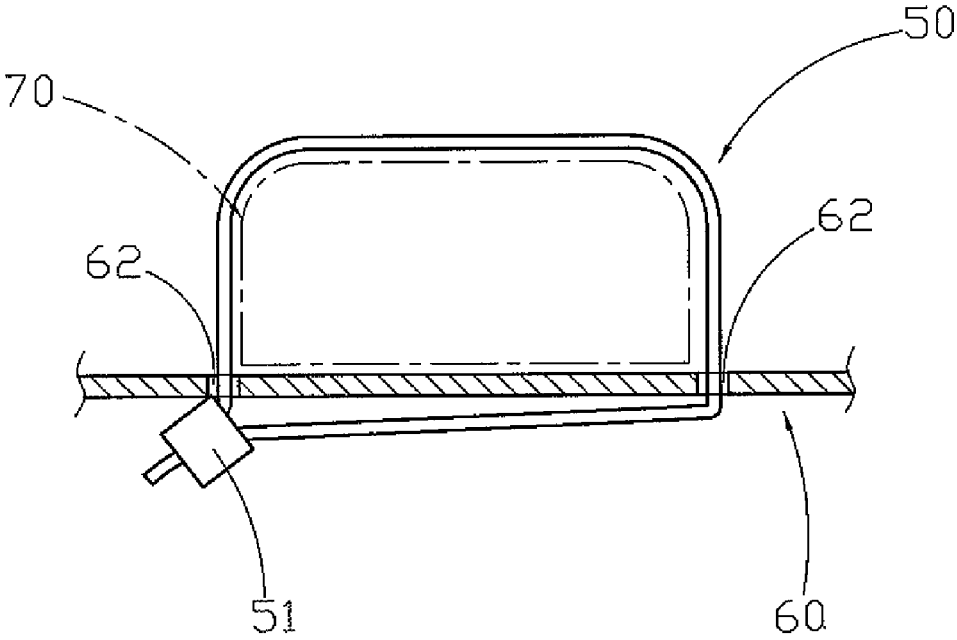
FIG. 11 PRIOR ART
FIG. 11 is a top cross-sectional view of a conventional tool suspension rack in accordance with the prior art.

Referring to FIGS. 9 and 10, the tool suspension rack further comprises a washer 40 mounted on the clamping strap 10 and located between one pair of the locking pieces 11 of the clamping strap 10 and the side 22 of the support board 20 to enhance a combination strength of the clamping strap 10 and the support board 20. The washer 40 has a substantially circular shape and has a size grater than that of each of the two through holes 21 of the support board 20. The washer 40 is provided with a through bore 42 to allow passage of the locking pieces 11 of the clamping strap 10.

Accordingly, the locking pieces 11 of the clamping strap 10 in turn extend through the two through holes 21 of the support board 20 to clamp and tighten the tool 30 between the clamping strap 10 and the support board 20 easily and quickly, thereby facilitating a user mounting the tool 30 onto the tool suspension rack.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A tool suspension rack, comprising:

a support board provided with two through holes;

an elongate flexible clamping strap extending through the two through holes of the support board and provided with a plurality of barb-shaped locking pieces extending through at least one of the two through holes of the support board and locked on a side of the support board;

wherein the clamping strap has a first end provided with the locking pieces and a second end provided with a limit head abutting the side of the support board; and the tool suspension rack further comprises:

a washer mounted on the clamping strap and located between one pair of the locking pieces of the clamping strap and the side of the support board.

2. The tool suspension rack in accordance with claim 1, wherein the locking pieces of the clamping strap are arranged in pairs.

3. The tool suspension rack in accordance with claim 2, wherein the locking pieces of the clamping strap project outwardly from two opposite sides of the clamping strap in an oblique manner.

4. The tool suspension rack in accordance with claim 1, wherein the limit head of the clamping strap has a substantially circular shape.

5. The tool suspension rack in accordance with claim 1, wherein the limit head of the clamping strap has a size grater than that of each of the two through holes of the support board.

6. The tool suspension rack in accordance with claim 1, wherein the locking pieces of the clamping strap are integrally formed on the clamping strap.

7. The tool suspension rack in accordance with claim 1, wherein the locking pieces of the clamping strap extend through each of the two through holes of the support board.

8. The tool suspension rack in accordance with claim 3, wherein any two opposite locking pieces of the clamping strap have an acute angle to facilitate insertion of the locking pieces of the clamping strap through each of the two through holes of the support board.

9. The tool suspension rack in accordance with claim 8, wherein one pair of the locking pieces of the clamping strap are expanded to have an obtuse angle and to abut the side of the support board.

10. The tool suspension rack in accordance with claim 1, wherein the locking pieces of the clamping strap extend through one of the two through holes of the support board until the limit head of the clamping strap abuts the side of the support board;

the locking pieces of the clamping strap extend through the other one of the two through holes of the support board.

11. The tool suspension rack in accordance with claim 1, wherein the clamping strap has two opposite ends each provided with the locking pieces.

12. The tool suspension rack in accordance with claim 11, wherein the locking pieces of each of the two opposite ends of the clamping strap extend through a respective one of the two through holes of the support board respectively.

13. The tool suspension rack in accordance with claim 1, wherein the washer has a substantially circular shape.

14. The tool suspension rack in accordance with claim 1, wherein the washer has a size grater than that of each of the two through holes of the support board.

15. The tool suspension rack in accordance with claim 1, wherein the washer is provided with a through bore to allow passage of the locking pieces of the clamping strap.

* * * * *